US007557228B2

(12) United States Patent
Basri et al.

(10) Patent No.: US 7,557,228 B2
(45) Date of Patent: Jul. 7, 2009

(54) PRODUCTION OF WAX ESTERS

(75) Inventors: Mahiran Basri, Selangor Darul Ehsan (MY); Mohd. Basyaruddin Abd. Rahman, Selangor Darul Ehsan (MY); Abu Bakar Salleh, Selangor Darul Ehsan (MY); Raja Noor Zaliha Abd. Rahman, Selangor Darul Ehsan (MY)

(73) Assignee: Universiti Putra Malaysia, Selangor Darul Ehsan (MY)

( * ) Notice: Subject to any disclaimer, the term of this patent is extended or adjusted under 35 U.S.C. 154(b) by 381 days.

(21) Appl. No.: 11/024,820

(22) Filed: Dec. 30, 2004

(65) Prior Publication Data

US 2006/0149086 A1 Jul. 6, 2006

(51) Int. Cl.
*C11C 1/00* (2006.01)
*C11C 3/00* (2006.01)

(52) U.S. Cl. ..... 554/167; 435/134

(58) Field of Classification Search ..... None
See application file for complete search history.

(56) References Cited

U.S. PATENT DOCUMENTS 5,128,251 A * 7/1992 Yokomichi et al. ..... 435/134
6,274,751 B1 * 8/2001 Tacconi ..... 554/224

FOREIGN PATENT DOCUMENTS

GB 2188057 A 9/1987
JP 63-251089 A 10/1988

OTHER PUBLICATIONS

Rahman et al., Malaysian JOurnal of Chemistry, vol. 3, No. 1, pp. 46-50, 2001.*
Gunawan et al., Journal of Oleo Science, vol. 55, No. 10, pp. 471-477, 2004.*
Hadzir et al., Journal of Chemical Technology and Biotechnology, vol. 76, pp. 511-515, 2001.*
Basri et al., JAOCS, vol. 72, pp. 407-411, 1995.*
Gunawan, et al. "Lipase-Catalyzed Synthesis of Palm-Based Wax Esters" Journal of Oleo Science; vol. 53, No. 10, pp. 471-477; 2004.
Salis, et al.; "Wax Esters Synthesis From Heavy Fraction of Sheep Milk Fat and Cetyl Alcohol by Immobilised Lipases"; Journal of Molecular Catalysis B: Enzymatic 21; pp. 167-174; 2003.
Chen, et al.; "Wax Ester Synthesis by Lipase-Catalyzed Esterification With Fungal Cells Immobilized on Cellulose Biomass Support Particles" Enzyme and Microbial Technology; vol. 20; pp. 615-622; Jun. 1997.

(Continued)

*Primary Examiner*—Deborah D Carr
(74) *Attorney, Agent, or Firm*—Birch, Stewart, Kolasch & Birch, LLP

(57) ABSTRACT

Wax esters are prepared by reacting a solution of palm oil in an organic solvent with oleyl alcohol in the presence of an immobilized lipase wherein molar ratio of palm oil to oleyl alcohol is between 1:2 and 1:4. Immobilized lipase used is present in an amount which is equivalent to not less than 1000 μg of protein per milli-mole of palm oil used and the reaction is carried out at 40° C. to 50° C. for a period of not less than 5 hours. The organic solvent used has a value of log P not less than 3.5.

6 Claims, 7 Drawing Sheets

Figure 1:
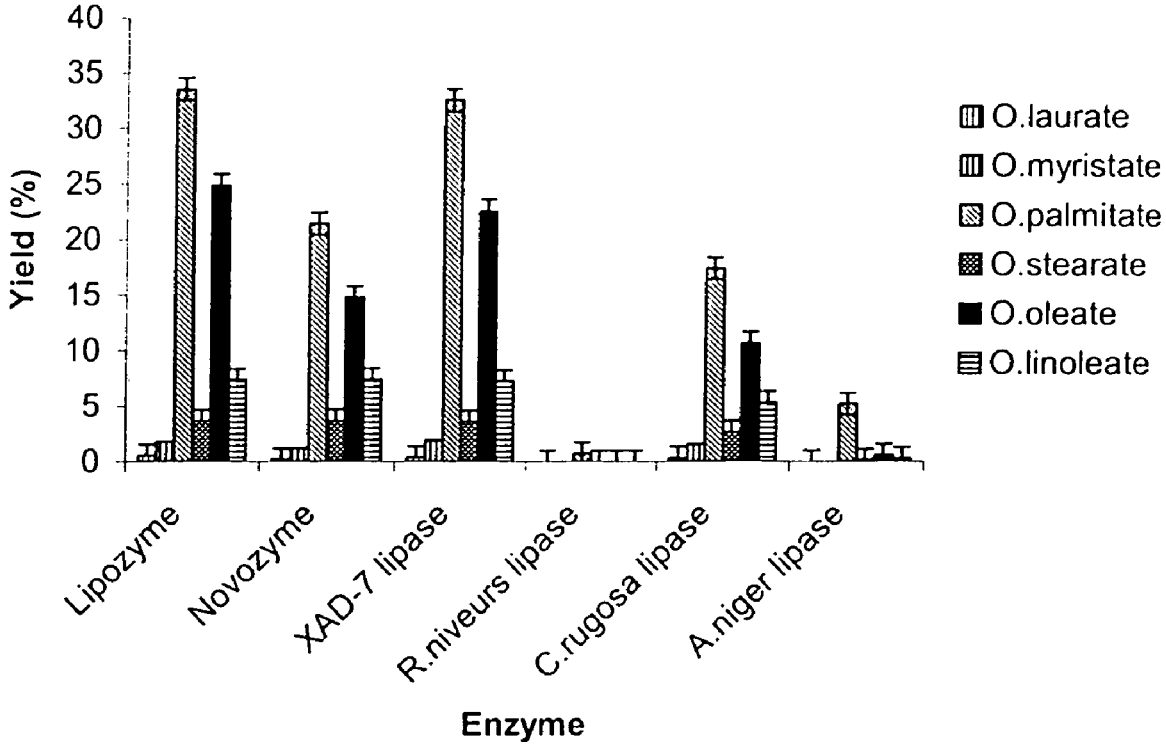

Effect of initial water activity ($a_w$) on the percentage yield of wax esters

OTHER PUBLICATIONS

Hallberg, et al.; "Enzymatic Synthesis of Wax Esters From Rapeseed Fatty Acid Methyl Esters and a Fatty Alcohol"; JAOCS Press; vol. 76, No. 2; 1999; pp. 183-187.

Knox, et al.; "Synthesis of Long-Chain Esters in a Loop Reactor System Using a Fungal Cell Bound Enzyme"; Process Biochemistry; Oct. 1984; pp. 188-192.

Ampon, et al.; "Enzymic Synthesis of Fatty Esters by Hydrophobic Lipase Derivatives Immobilized on Organic Polymer Beads" JAOCS; vol. 72, No. 4; 1995; pp. 407-411.

Basri, et al.; Stability of Hydrophobic Lipase Derivatives Immobilized on Organic Polymer Beads; Applied Biochemistry and Biotechnology; vol. 48; pp. 173-183; 1994.

Decagny, et al.; "Synthesis of Wax Ester Through Triolein Alcoholysis: Choice of the Lipase and Study of the Mechanism"; Enzyme and Microbial Technology; vol. 22; 1998; pp. 578-582.

Hadzir, et al.; "Enzymatic Alcoholysis of Triolein to Produce Wax Ester" Society of Chemical Industry; Chem Technol Biotechnol; vol. 76; 2001; pp. 511-515.

Choo Y M, et al.; "Enzyme Catalyzed Esterification of Palm Oil" Porim Intl. Palm Oil Conf—Chemistry & Technology; pp. 327-332; 1991.

Steinke, et al.; "High-Yield Preparation of Wax Esters via Lipase-Catalyzed Esterification Using Fatty Acids and Alcohols From Crambe and Camelina Oils"; J. Agric Food Chem; vol. 49; pp. 647-657; 2001.

Stevenson, et al.; "Near-Quantitative Production of Fatty Acid Alkyl Esters by Lipase-Catalyzed Alcoholysis of Fats and Oils With Adsorption of Glycerol by Silica Gel"; Enzyme Microb. Technol., vol. 16; pp. 478-484; 1994.

Kimia, et al.; "Synthesis of Oleyl Oleate, a Liquid Wax Ester, Using Lipozyme"; Malaysian Journal of Chemistry, vol. 3, No. 1; pp. 46-50; 2001.

Chowdary, et al.; "The Influence of Water Activity on the Lipase Catalyzed Synthesis of Butyl Butyrate by Transesterification"; Process Biochemistry; vol. 38; pp. 393-397; 2002.

* cited by examiner

Screening of enzyme

Note : XAD-7 lipase refers to immobilized lipase from *Candida rugosa* .

Effect of reaction time on the percentage yield of wax esters

Effect of temperature on the percentage yield of wax esters

Effect of amount of enzyme on the percentage yield of wax esters

Effect of molar ratio of substrate on the percentage yield of wax esters

Effect of various organic solvents on the percentage yield of wax esters

Effect of initial water activity ($a_w$) on the percentage yield of wax esters

PRODUCTION OF WAX ESTERS

The present invention relates to the production of wax esters. More particularly this invention relates to the production of wax esters from palm oil.

Esters of short chain fatty acids and alcohols are important in the food industry as flavor and aroma constituent. Methyl and ethyl esters of long chain fatty acids are valuable oleo chemicals that may be used as replacement for diesel oil. Wax esters are long chain esters derived from fatty acids and alcohols both with chain lengths of 12 carbons or more. Unsaturated or liquid wax esters derived from natural sources such as jojoba oil and sperm whale oil have been dominantly used in the lubricants, plasticizers and cosmetics market. This is due to their unique properties of being able to impart wetting behavior at interfaces and having a non greasy feeling when applied on skin surfaces. However, the main obstacle to large-scale use of natural sources of unsaturated wax esters is its cost and availability.

Since natural unsaturated wax esters are expensive and limited in access, the need to synthesize unsaturated wax esters has grown. Unsaturated wax esters can be synthesized using chemical-catalyzed and enzymatic-catalyzed methods. However, chemical-catalyzed method leads to high-energy consumption and degradation of the esters produced. Enzymatic catalyzed method offers mild reaction conditions and is an environmental friendly process.

Enzymatic synthesis of fatty esters has been known for a long time. An efficient process exists to enzymatically esterify purified fatty acids with alcohols but alcoholysis of oils and fats is simpler and the starting material is cheaper.

U.K. Patent No GB2188057 discloses the preparation of akyl esters from fats and oils and glyceride-containing fractions thereof by mixing a solution of the fat or oil in an inert organic solvent with an alkanol in the presence of a lipase and high content of water.

Japanese Patent No. JP63251089 discloses the preparation of wax esters from vegetables, animals or synthetic fats and oils by alcoholysis of the fats and oils using 6-24C mono- or dihydric aliphatic alcohol in the presence of a lipase and high content of water.

Stevenson et. al. published a method of near quantitative production of fatty acid alkyl esters by lipase-catalyzed alcoholysis of fats and oils with adsorption of glycerol by silica gel (Enzyme Microb. Technol., 16:474-484 [1994]). In the alcoholysis process, the products are not only fatty acid alkyl esters but also glycerol. Glycerol may inhibit the reaction by limiting the interaction of the substrate and the enzyme. When immobilized *Mucor miehei* lipase is used to catalyze the reaction of tallow with three molar equivalents of butanol, the yield of butyl esters did not exceed 70% (w/w). If silica gel is added to the reaction mixture, it adsorbed the glycerol produced during the reaction and the yield increased up to 98%.

The present invention provides a method of producing wax esters from fats and oils, particularly palm oil by alcoholysis of the fats and oils with long chain alcohol, particularly oleyl alcohol in the presence of an immobilized lipase. Good yield (~80%) of wax esters can be expected without having to provide a high content of water or a means of glycerol adsorption.

Wax esters are prepared by reacting a solution of palm oil in an organic solvent with oleyl alcohol in the presence of an immobilized lipase wherein molar ratio of palm oil to oleyl alcohol is between 1:2 and 1:4. Immobilized lipase used is present in an amount which is equivalent to not less than 1000 μg of protein per milli-mole of palm oil used and the reaction is carried out at 40° C. to 50° C. for a period of not less than 5 hours. The organic solvent used has a value of log P not less than 3.5.

The present invention will become more fully understood from the detailed description given herein below and the accompanying drawings which are given by way of illustration only, and thus are not limitative of the present invention, wherein:

FIG. 1 shows the screening of enzyme. The reaction mixture consisted of palm oil (1 mmol), oleyl alcohol (3 mmol), hexane (to a total volume of 10 $cm^3$) and enzyme. The reaction mixture is incubated at 40° C. and shaken at a speed of 150 rpm for 24 h. The enzymes tested were immobilized lipase from *Mucor miehei* (Lipozyme® produced by Novo Nordisk), immobilized lipase from *Candida antartica* (Novozym 435 produced by Novo Nordisk), immobilized lipase from *Candida rugosa, Rhizopus niveus* lipase, *Candida rugosa* lipase, *Aspergilus niger* lipase.

Designation—O.laurate:oleyl laurate, o.myristate:Oleyl myristate, O.palmitate:oleyl palmitate, O.stearate:oleyl stearate, O.oleate:oleyl oleate:O.linoleate:oleyl linoleate.

Figure 2:
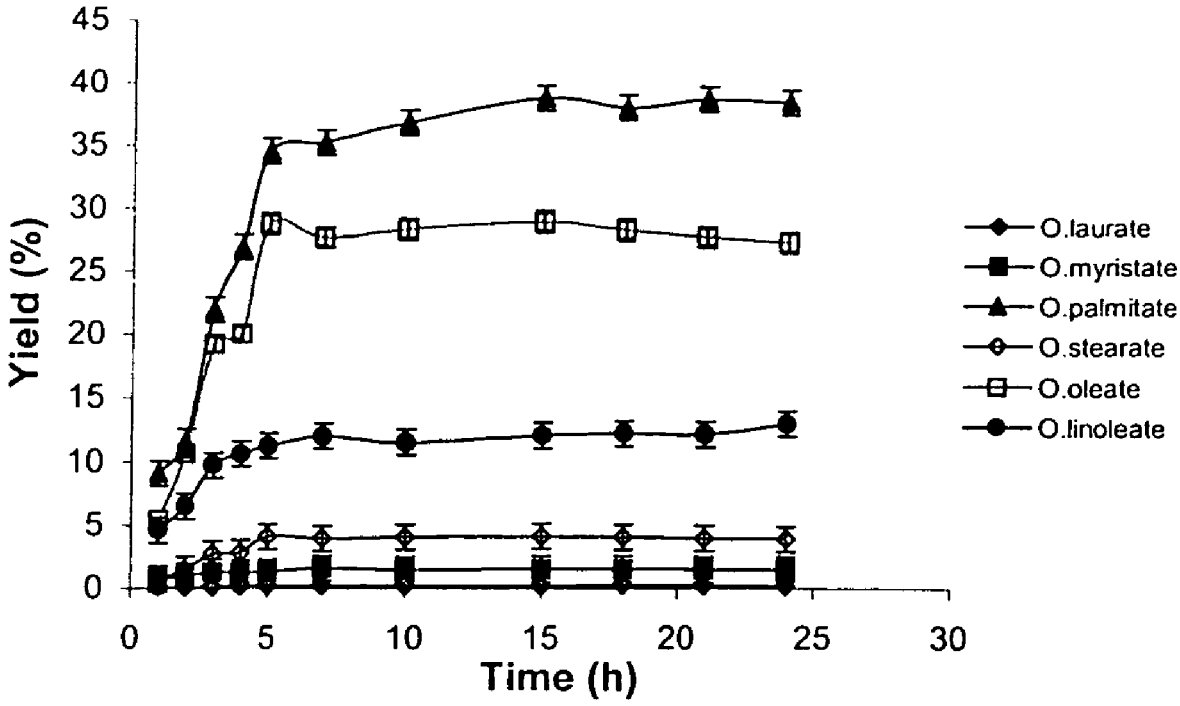

FIG. 2 shows the effect of reaction time on the percentage yield of wax esters. The reaction mixture consisted of palm oil (1 mmol), oleyl alcohol (3 mmol), hexane (to a total volume of 10 $cm^3$) and Lipozyme® (0.15 g). The reaction mixture is incubated at 40° C. and shaken at a speed of 150 rpm.

Designation—O.laurate:oleyl laurate, O.myristate:oleyl myristate, O.palmitate:oleyl palmitate, O. stearate:oleyl stearate, O. oleate:oleyl oleate, O. linoleate:oleyl linoleate.

Figure 3:
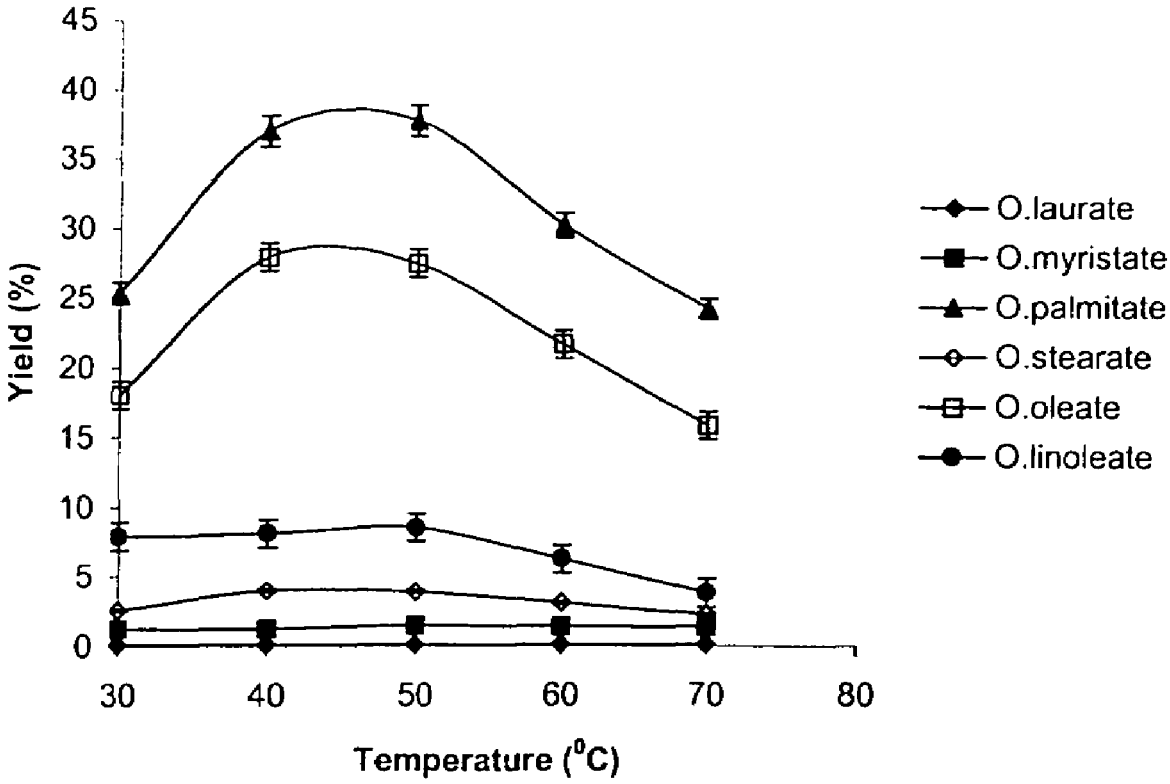

FIG. 3 shows the effect of temperature on the percentage yield of wax esters. The reaction mixture consisted of palm oil (1 mmol), oleyl alcohol (3 mmol), hexane (to a total volume of 10 $cm^3$) and Lipozyme® (0.15 g). The reaction mixture is shaken at a speed of 150 rpm for 5 h.

Designation—O.laurate:oleyl laurate, O.myristate:oleyl myristate, O.palmitate:Oleyl palmitate, O. stearate:oleyl stearate, O. oleate:oleyl oleate, O. linoleate:Oleyl linoleate.

Figure 4:
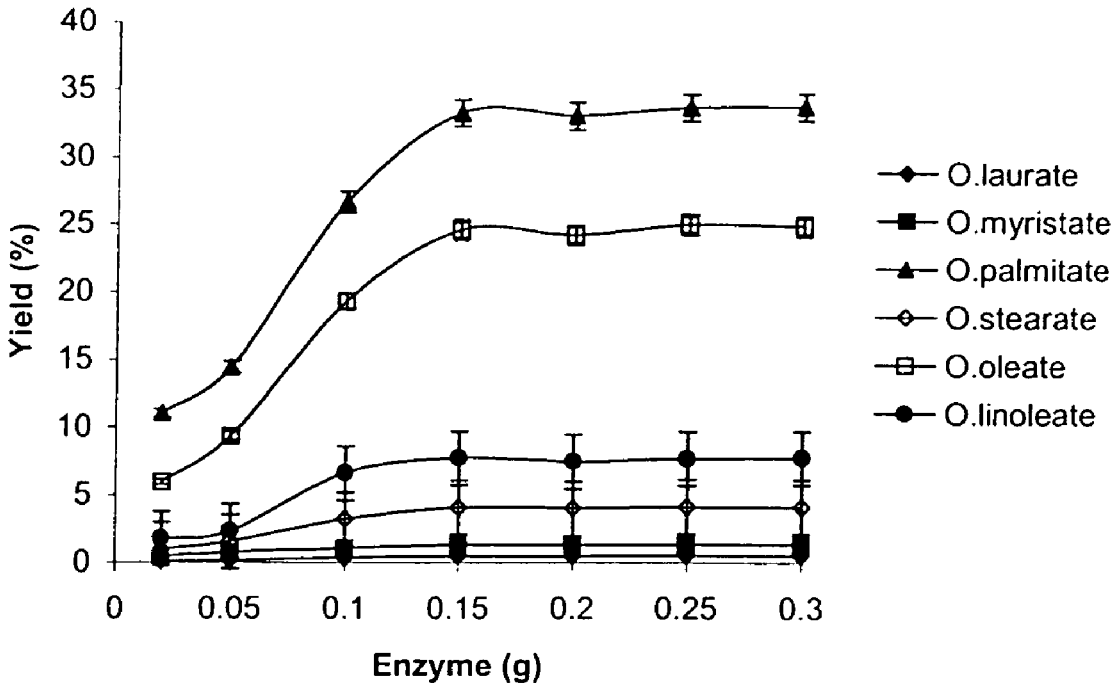

FIG. 4 shows the effect of amount of enzyme on the percentage yield of wax esters. The reaction mixture consisted of palm oil (1 mmol), oleyl alcohol (3 mmol), hexane (to a total volume of 10 $cm^3$) and Lipozyme®). The reaction mixture is incubated at 50° C. and shaken at a speed of 150 rpm for 5 h.

Designation—O.laurate:oleyl laurate, O.myristate:oleyl myristate, O.palmitate:oleyl palmitate, O. stearate:oleyl stearate, O. oleate:oleyl oleate, O. linoleate:oleyl linoleate.

Figure 5:
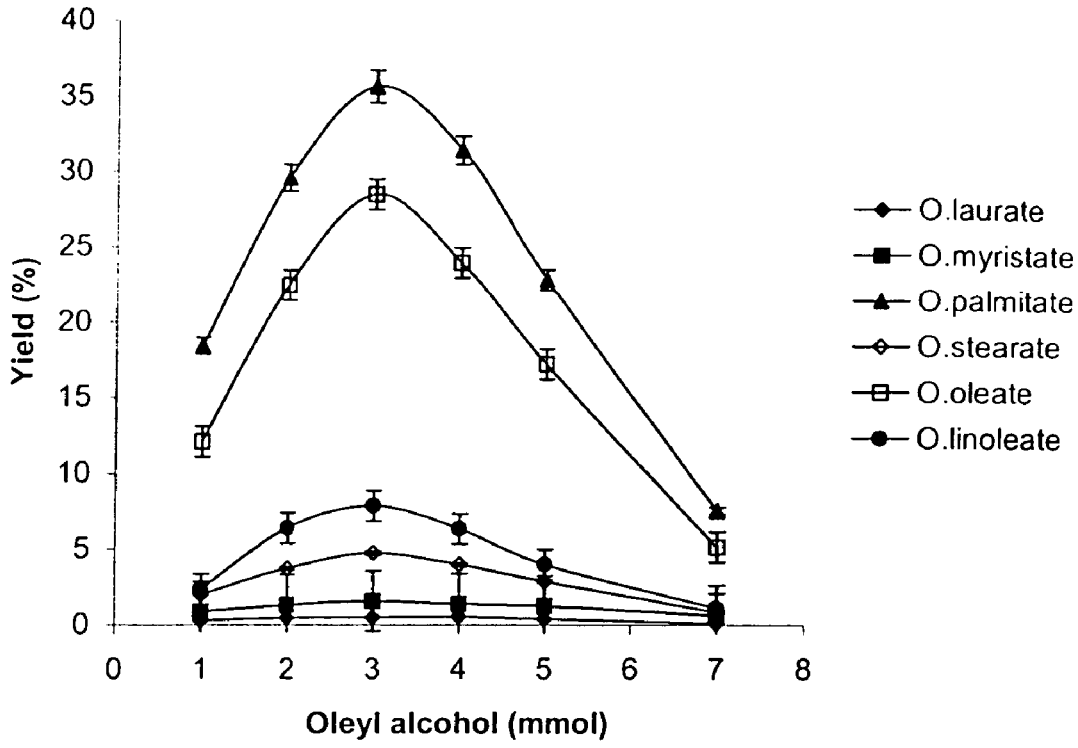

FIG. 5 shows the effect of molar ratio of substrate (oleyl alcohol, n mmol/palm oil, 1 mmol) on the percentage yield of wax esters. The reaction mixture consisted of palm oil (1 mmol), oleyl alcohol (3 mmol), hexane (to a total volume of 10 $cm^3$) and Lipozyme® (0.15 g). The reaction mixture is incubated at 50° C. and shaken at a speed of 150 rpm for 5 h.

Designation—O.laurate; oleyl laurate, O.myristate; oleyl myristate, O.palmitate; oleyl palmitate, O. stearate; oleyl stearate, O. oleate; oleyl oleate, O. linoleate; oleyl linoleate.

Figure 6:
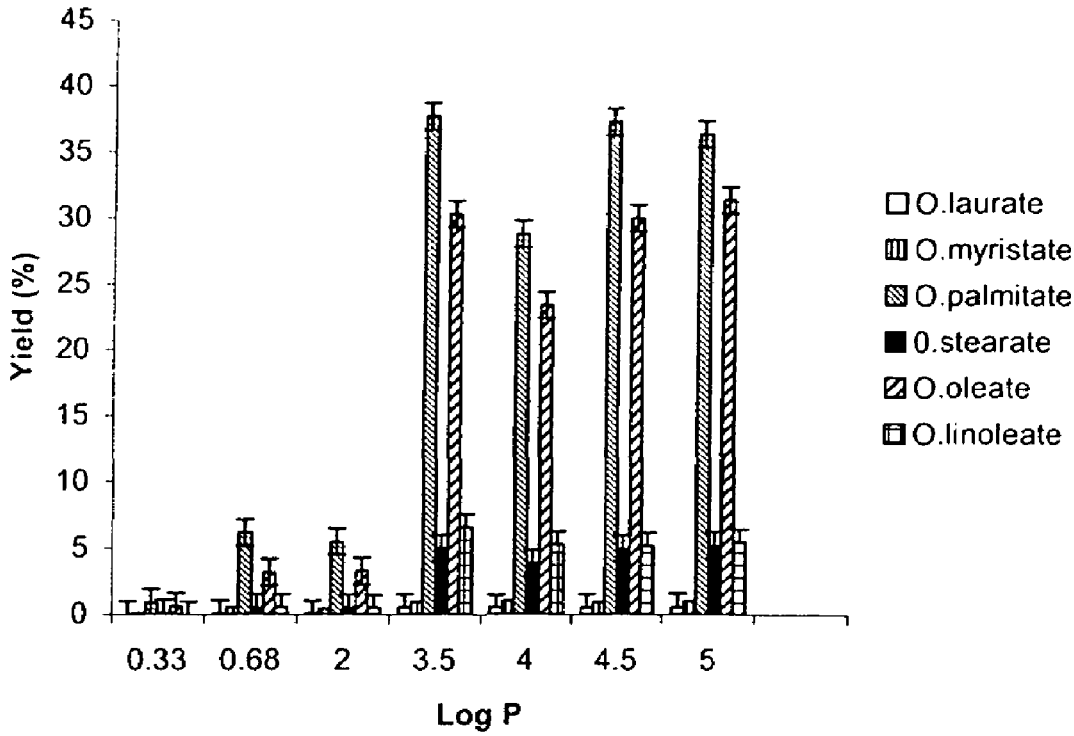

FIG. 6 shows the effect of various organic solvents on the percentage yield of wax esters. The reaction mixture consisted of palm oil (1 mmol), oleyl alcohol (3 mmol), solvents (to a total volume of 10 $cm^3$) and Lipozyme® (0.15 g). The reaction mixture is incubated at 50° C. and shaken at a speed of 150 rpm for 5 h. The solvents used were acetonitrile (log P=0.33), ethyl acetate (log P=0.68), chloroform (log P=2), hexane (log P=3.5), heptane (log P=4.0), isooctane (log P=4.5) and nonane (log P=5.0).

Designation—O.laurate:Oleyl laurate, O.myristate:Oleyl myristate, O.palmitate:Oleyl palmitate, O. stearate:Oleyl stearate, O. oleate:Oleyl oleate, O. linoleate:Oleyl linoleate.

Figure 7:
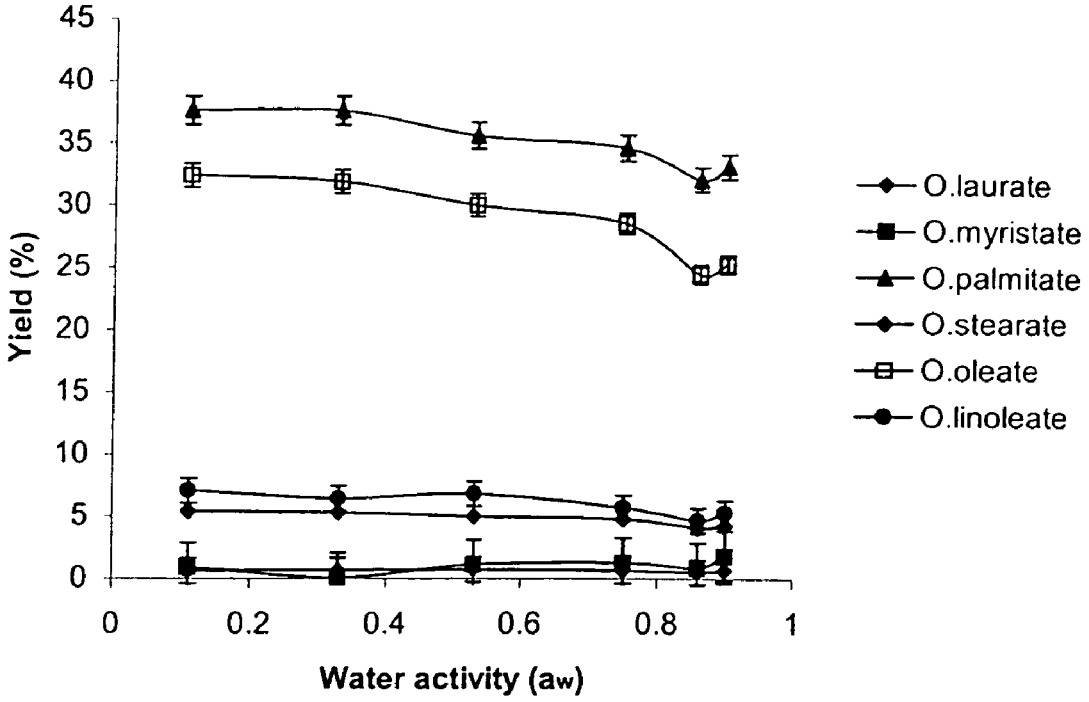

FIG. 7 shows the effect of initial water activity ($a_w$) on the percentage yield of wax esters. The reaction mixture consisted of palm oil (1 mmol), oleyl alcohol (3 mmol), hexane (to a total volume of 10 $cm^3$) and Lipozyme® (0.15 g). The reaction mixture is incubated at 50° C. and shaken at a speed of 150 rpm for 5 h. The salts used were LiCl (0.11), $MgCl_2 6H_2O$ (0.33), $Mg(NO_3)_2.6H_2O$ (0.53), NaCl (0.75), KCl (0.86), $KNO_3$ (0.90).

Designation—O.laurate:oleyl laurate, O.myristate:oleyl myristate, O.palmitate:oleyl palmitate, O. stearate:oleyl stearate, O. oleate:oleyl oleate, O. linoleate:oleyl linoleate.

A general step for producing wax esters in the current invention is mixing 1 mmol of palm oil with 3 mmol of oleyl alcohol and 0.15 g of Lipozyme®. Then, hexane is added to the reaction mixture to a total volume of 10 $cm^3$ or to a volume sufficient to solubilize palm oil. Finally, the reaction mixture is incubated in a horizontal shaker water bath with a speed of 150 rpm at 40° C. for 24 hours to enable enzymatic alcoholysis reaction. These steps are followed to determine optimum conditions for producing wax esters unless otherwise stated.

Lipase from different sources is employed for catalyzing alcoholysis reaction between palm oil and oleyl alcohol. Six commercial lipases tested were 0.15 g of immobilized lipase from *Mucor miehei* (Lipozyme® produced by Novo Nordisk) containing 1098 μg of protein, 0.15 g of immobilized lipase from *Candida antartica* (Novozym 435 produced by Novo Nordisk) containing 1143 μg of protein, 0.13 g of immobilized lipase from *Candida rugosa* containing 1105 μg of protein, 0.07 g of lipase from *Rhizopus niveurs* containing 2240 μg of protein, 0.21 g of lipase from *Candida rugosa* containing 2238 μg of protein and 0.1 g of lipase from *Aspergilus niger* containing 2228 μg of protein. The immobilized lipase from *Candida rugosa* is produced by immobilizing lipase from *Candida rugosa* on Amberlite XAD 7. Protein content in various lipases is determined by using Lowry method with bovine serum albumin as standard. Percentage yield as determined is as shown in FIG. 1.

Highest percentage yield is shown by using Lipozyme® (75%) followed by immobilized lipase from *Candida rugosa* and Novozym 435. Other lipases showed only low percentage yield (less than 30%).

Time course for enzymatic alcoholysis reaction is presented in FIG. 2. Percentage yield increased with increasing reaction time. Lipozyme® as biocatalyst gives high percentage yield within a reaction period of 5 to 7 hours. After 7 hours, the percentage yield is relatively constant. This may be due to the enzymatic alcoholysis reaction has achieved equilibrium state whereby the rate of forward reaction is equal to the rate of backward reaction.

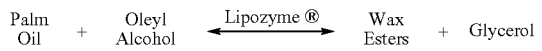

Furthermore, in the enzymatic alcoholysis reaction between palm oil and oleyl alcohol, wax esters are not the only product but glycerol as well. Accumulated glycerol will inhibit the alcoholysis reaction by limiting interaction of the substrate and the biocatalyst.

Enzymatic alcoholysis reaction between palm oil and oleyl alcohol is performed at 5 different temperatures for 5 hours each. Percentage yield of wax ester increased with increasing temperature from 30° C. to 50° C. as shown in FIG. 3. Low percentage yield is observed at lower temperature (30° C.) because of the relatively low enzyme activity. The percentage yield of wax esters is decreased at 60° C. to 70° C. This may be due to the denaturation of the enzyme at relatively higher temperatures.

FIG. 4 shows the result of using different amount of Lipozyme® in enzymatic alcoholysis reaction between palm oil and oleyl alcohol. The enzymatic alcoholysis reaction is conducted at 50° C. for 5 hours each. Percentage yield of wax esters increased as the amount of Lipozyme® increased to 1.5% [weight of Lipozyme® (g) to total volume ($cm^3$) of reaction mixture basis]. Excess Lipozyme® has little effect on the percentage yield of wax esters. This may be due to the limitation of the amount of substrates used. Protein content in Lipozyme® as determined by using Lowry method with bovine serum albumin as standard is as shown in Table 1.

TABLE 1

Protein content in Lipozyme ®

| Amount of Lipozyme ® used (g) | Protein Content (μg) |
|---|---|
| 0.05 | 366 |
| 0.10 | 732 |
| 0.15 | 1098 |
| 0.20 | 1464 |
| 0.25 | 1830 |
| 0.30 | 2196 |

Effect of using different molar ratio of substrates in enzymatic alcoholysis reaction between palm oil and oleyl alcohol at 50° C. for 5 hours each is shown in FIG. 5. There is a relatively sharp optimum wax esters yield around 3 equivalents of oleyl alcohol to 1 equivalent of palm oil. This is similar with stoichiometric mixtures of reaction between palm oil and oleyl alcohol.

Polarity of various solvents in terms of their log-P values played the most crucial role in the course of enzymatic alcoholysis reaction between palm oil and oleyl alcohol. Effect of using various organic solvents in forming the reaction mixtures is shown in FIG. 6. The solvents used are acetonitrile (log P=0.33), ethyl acetate (log P=0.68), chloroform (log P=2), hexane (log P=3.5), heptane (log P=4.0), isooctane (log P=4.5) and nonane (log P=5.0). The enzymatic alcoholysis-reactions are conducted at 50° C. for 5 hours each. In general, it is observed that percentage yield increased with increasing log P value of the solvent. The most suitable organic solvents for forming reaction mixtures in the present invention are solvents with relatively higher log P value, particularly solvents with log P value not less than 3.5.

Influence of water activity on synthesis of wax esters by enzymatic alcoholysis reaction using Lipozyme® as biocatalyst is determined by pre-equilibrating Lipozyme® and substrates with vapor of saturated salt solutions with different water activity ($a_w$) values at ambient temperature (approximately 25° C.) in separate containers overnight for at least 16 hours. The salts used are LiCl ($a_w$=0.11), $MgCl_2 6H_2O$ ($a_w$=0.33), $Mg(NO_3)_2 6H_2O$ ($a_w$=0.53), NaCl ($a_w$=0.75), KCl ($a_w$=0.86) and $KNO_3$ ($a_w$=0.9). Enzymatic alcoholysis reactions are then conducted at 50° C. for 5 hours each. The percentage yield of wax esters is shown in FIG. 7. The percentage yield of wax esters is not much affected by the water activity value of the reaction mixtures.

Thus, optimum yield is obtained by using optimum conditions for enzymatic alcoholysis reaction to synthesize wax esters. For optimum yield, hexane is added to a reaction mixture consists of 1 mmol palm oil, 3 mmol oleyl alcohol and 0.15 g Lipozyme® to a total volume of 10 $cm^3$. The reaction mixture is then incubated in a horizontal shaker water bath with a speed of 150 rpm at 50° C. for 5 hours to enable enzymatic alcoholysis reaction. Percentage yield of wax esters obtained is 80.62%.

The invention claimed is:

1. A process for the preparation of wax esters which comprises reacting a solution of palm oil in an organic solvent with oleyl alcohol in the presence of an immobilized lipase from *Muco miehei*, wherein the initial water activity ranges from 0.1 to 0.8 and wherein the change in wax ester yield across the range of initial water activity is less than 3%.

2. The process according to claim 1, wherein the molar ratio of palm oil to oleyl alcohol is between 1:2 and 1:4.

3. The process according to claim 1, wherein the process is executed at a temperature within the range of 40° C. to 50° C. for a period of time of not less than 5 hours.

4. The process according to claim 1, wherein the immobilized lipase is present in an amount which is equivalent to not less than 1000 μg of protein per milli-mole of palm oil used.

5. The process according to claim 1, wherein the organic solvent has a value of log P of not less than 3.5.

6. A process for the preparation of wax esters, which comprises:

i) mixing 1 mmol palm oil and 3 mmol oleyl alcohol with 0.15 g immobilized *Mucor miehei* lipase containing 1098 μg of protein to form a mixture, ii) adding hexane to the mixture obtained in step (i) to a total volume of 10 $cm^3$, and iii) incubating the resultant mixture from step (ii) at 50° C. for 5 hours, wherein the initial water activity ranges from 0.1 to 0.8 and wherein the change in wax ester yield across the range of initial water activity is less than 3%.

* * * * *